US011932481B2

(12) United States Patent
Goose et al.

(10) Patent No.: US 11,932,481 B2
(45) Date of Patent: Mar. 19, 2024

(54) END-CLOSURE FOR A FLEXIBLE TANK

(71) Applicant: Odyssey Logistics & Technology Corporation, Danbury, CT (US)

(72) Inventors: Roger G. Goose, Horseshoe Bay, TX (US); Douglas B. Postek, Katy, TX (US)

(73) Assignee: Odyssey Logistics & Technology Corporation, Danbury, CT (US)

( * ) Notice: Subject to any disclaimer, the term of this patent is extended or adjusted under 35 U.S.C. 154(b) by 0 days.

(21) Appl. No.: 17/962,934

(22) Filed: Oct. 10, 2022

(65) Prior Publication Data

US 2023/0108582 A1 Apr. 6, 2023

Related U.S. Application Data

(63) Continuation of application No. 17/114,036, filed on Dec. 7, 2020, now Pat. No. 11,465,831, which is a continuation of application No. 16/177,121, filed on Oct. 31, 2018, now Pat. No. 10,858,178.

(60) Provisional application No. 62/579,612, filed on Oct. 31, 2017.

(51) Int. Cl.
*B65D 88/16* (2006.01)
*B65D 88/22* (2006.01)

(52) U.S. Cl.
CPC ..... *B65D 88/1618* (2013.01); *B65D 88/16* (2013.01); *B65D 88/1656* (2013.01); *B65D 88/1668* (2013.01); *B65D 88/22* (2013.01); *B65D 2590/0066* (2013.01)

(58) Field of Classification Search
CPC ..... B65D 88/1618; B65D 88/16; B65D 88/1656; B65D 88/1668; B65D 88/22; B65D 2590/0066
USPC ..... 220/562
See application file for complete search history.

(56) References Cited

U.S. PATENT DOCUMENTS 2,724,418 A * 11/1955 Krupp ..... F16K 17/0486 244/134 B
2,997,973 A * 8/1961 Hawthorne ..... B63B 35/285 114/74 T
3,067,712 A * 12/1962 Doerpinghaus ..... B63B 35/285 114/253
3,416,762 A * 12/1968 Headrick ..... B64D 37/12 410/97
3,510,142 A * 5/1970 Erke ..... B60P 3/426 383/3
4,132,310 A * 1/1979 Dorsch ..... B60P 7/12 206/386
4,573,508 A * 3/1986 Knaus ..... B65D 88/1656 220/666
4,865,096 A * 9/1989 Schober ..... B65D 88/16 220/666
4,875,596 A * 10/1989 Lohse ..... B65D 90/046 220/666
5,333,757 A * 8/1994 Volk ..... B65G 65/44 222/105

(Continued)

*Primary Examiner* — Peter N Helvey
(74) *Attorney, Agent, or Firm* — Bauer & Joseph; Robert M. Bauer

(57) ABSTRACT

A flexible tank has one or more inner layers and one or more outer layers enclosing the inner layers. It has an improved structure to prevent leakage and rupture when making a long multi-modal shipment of large quantities of a liquid, including when the flexible tank is not supported by the end or side walls of a shipping container.

19 Claims, 15 Drawing Sheets

(56) References Cited

U.S. PATENT DOCUMENTS

| | | | | | |
|---|---|---|---|---|---|
| 5,368,395 | A * | 11/1994 | Crimmins | B65D 88/1656 | 383/111 |
| 5,524,781 | A * | 6/1996 | Podd | B65D 90/046 | 383/103 |
| 6,186,713 | B1 * | 2/2001 | Bonerb | B60P 3/426 | 410/97 |
| 6,842,955 | B2 * | 1/2005 | Joshi | B65D 88/1656 | 73/49.3 |
| 6,860,218 | B2 * | 3/2005 | Eagles | B63B 35/285 | 114/256 |
| 7,717,296 | B1 * | 5/2010 | Guthrie | B65D 90/00 | 222/105 |
| 8,100,614 | B2 * | 1/2012 | Jerich | B60P 3/426 | 410/2 |
| 10,137,809 | B2 * | 11/2018 | Postek | B60N 2/6027 | |
| 10,836,298 | B1 * | 11/2020 | Bonnar | B65D 90/046 | |
| 2002/0030055 | A1 * | 3/2002 | Maturana | B65D 90/046 | 383/119 |
| 2006/0251343 | A1 * | 11/2006 | True | B65D 88/1606 | 383/118 |
| 2010/0272378 | A1 * | 10/2010 | Mueller | B65D 90/0033 | 493/214 |
| 2012/0087760 | A1 * | 4/2012 | Sims | B65D 90/047 | 410/52 |
| 2014/0154045 | A1 * | 6/2014 | Lee | B65D 90/046 | 414/808 |

* cited by examiner

Step (1)

Step (2)

Step (3)

Step (4)

END-CLOSURE FOR A FLEXIBLE TANK

This application is a continuation of U.S. patent application Ser. No. 17/114,036 filed on Dec. 7, 2020 (U.S. Pat. No. 11,465,831), which in turn is a continuation of U.S. patent application Ser. No. 16/177,121 filed on Oct. 31, 2018 (U.S. Pat. No. 10,858,178), which in turn claims priority to U.S. Provisional Patent Application No. 62/579,612 filed on Oct. 31, 2017, the contents of these patent applications hereby being incorporated by reference in their entirety into this application.

FIELD OF THE INVENTION

The invention relates to flexible tanks for transporting liquids or semi-liquid materials. More particularly, the invention relates to flexible tanks having improved resistance to leakage and rupture.

BACKGROUND

Lengthy shipments of goods frequently involve multiple modes of transport, such as ships, railroad cars and trucks. Standardized intermodal shipping containers can be easily moved from place to place in ports and warehouses, and between ships and railroad cars. The standards dictate certain characteristics such as size, location of doors, and the use of specific corners or fittings so that a container can be securely gripped and moved by equipment. Some containers may comply with the standards while having additional unique characteristics, such as being insulated or designed to transport liquids. However, the ability to use any generic standards-compliant shipping container is an advantage because the logistics of making many shipments of different kinds of goods is simplified when a particular shipping container is not necessary.

Flexible tanks (flexitanks) are useful because they enable one to transport bulk liquids within a generic intermodal shipping container so that a shipping container specifically designed for the transport of liquids is not necessary. A primary concern associated with flexitanks is the possibility of rupture. In addition to the obvious loss of the liquid inside, the rupture or failure of a liquid during transport can damage the container in which it is located. If rupture occurs while in the cargo hold of a ship, it may be undiscovered for a long period of time during which the liquid is loose within the cargo hold possibly causing damage thereto or to other containers. A related concern associated with flexitanks is movement of the flexitank within the container during transport. Movement can cause a rupture of a flexitank (even if there is no defect or weakness in the flexitank) by, for example, causing the flexitank to be caught on a snag, abrasion, burr, bolthead, or other deformity on the floor or wall of the container.

Rupture is most frequently the result of stress produced by the liquid dynamics exerted on the flexitank as the container and flexitank is subjected to certain motions. There can be pressure exerted on side walls of the container for example by up and down movement of a ship in windy seas. In particular, sudden starts or stops on a railcar are to be expected, and the liquid is then subjected to dynamic forces and can develop its own wave action. The pressure of such a wave when it hits an end seam of a flexitank can be tremendous. The forces increase exponentially as the volume of liquid and the length of the flexitank increases. For large quantities of a liquid, such as more than 8,000 liters, the forces exerted are quite likely to be too much for the ends of a conventional flexible tank to withstand. For this reason, the flexitank is conventionally longer than the internal length of the container so that the ends of the flexitank are supported by the front inside wall of the container and a bulkhead panel placed across the door opening at the rear wall. Therefore, the flexitank for a 20 foot shipping container may be, for example, 23 feet long. There is a further concern that the flexitank does not deform any of the side or end walls of the container in which it is placed. Intermodal shipping containers are sometimes stacked or placed very close together in cargo holds or ports, with only a few inches of tolerance, and an outwardly deformed wall may interfere with or prevent placement of the container.

Some shipping containers may not be well suited to supporting the ends of a flexitank because, for example, a bulkhead cannot be easily installed or the front wall is corrugated or otherwise configured such that it might cause a rupture of the flexitank. These circumstances are frequently present in larger shipping containers, such as 40 foot or 53 foot containers, or in certain containers such as UMAX® containers recently introduced by North American railroads. Conventional flexitank materials and construction techniques cannot withstand the greater dynamic forces when there is no end support. The ends of the flexitank woven polypropylene layers are typically joined together in a cross-stitched seam as shown in FIGS. 3(*a*)-(*c*) and the stitching is prone to being pulled out under the increased pressure. The ubiquity of using such larger shipping containers in some multimodal transport routes is such that it would be economically beneficial to have a flexitank to use in them even if the capacity of such a flexitank was not significantly greater than the capacity of a conventional flexitank used in smaller shipping containers.

BRIEF SUMMARY

It is an objective of the preferred embodiments of the invention to provide an improved flexible tank with an improved capability of preventing leakage and rupture when making a long multi-modal shipment of large quantities of a liquid, including when the flexible tank is not supported by the end or side walls of a shipping container.

DETAILED DESCRIPTION

Figure 1:
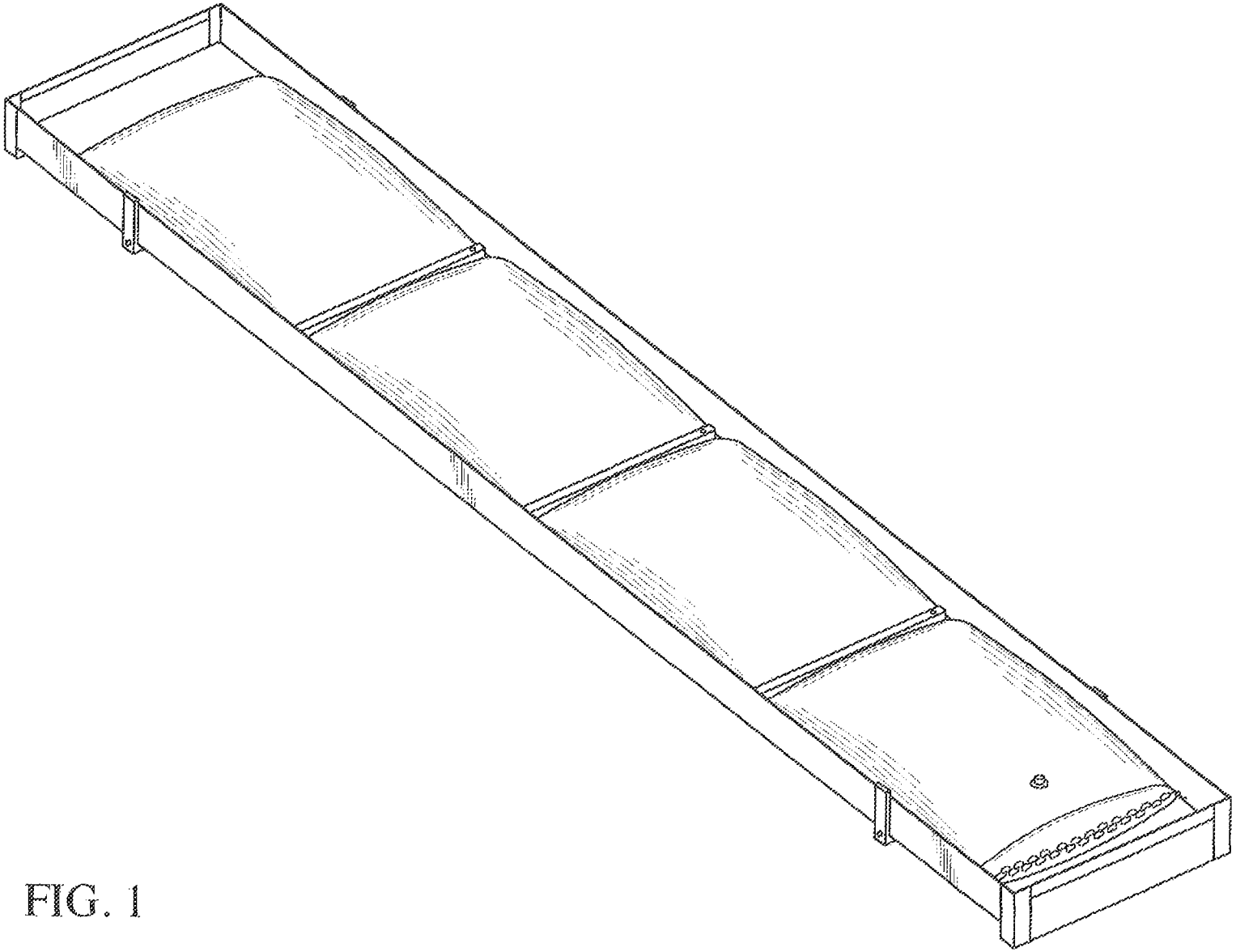
FIGS. 1 and 2 is a perspective view of a flexible tank in a partially cut-away shipping container.
Figure 2:
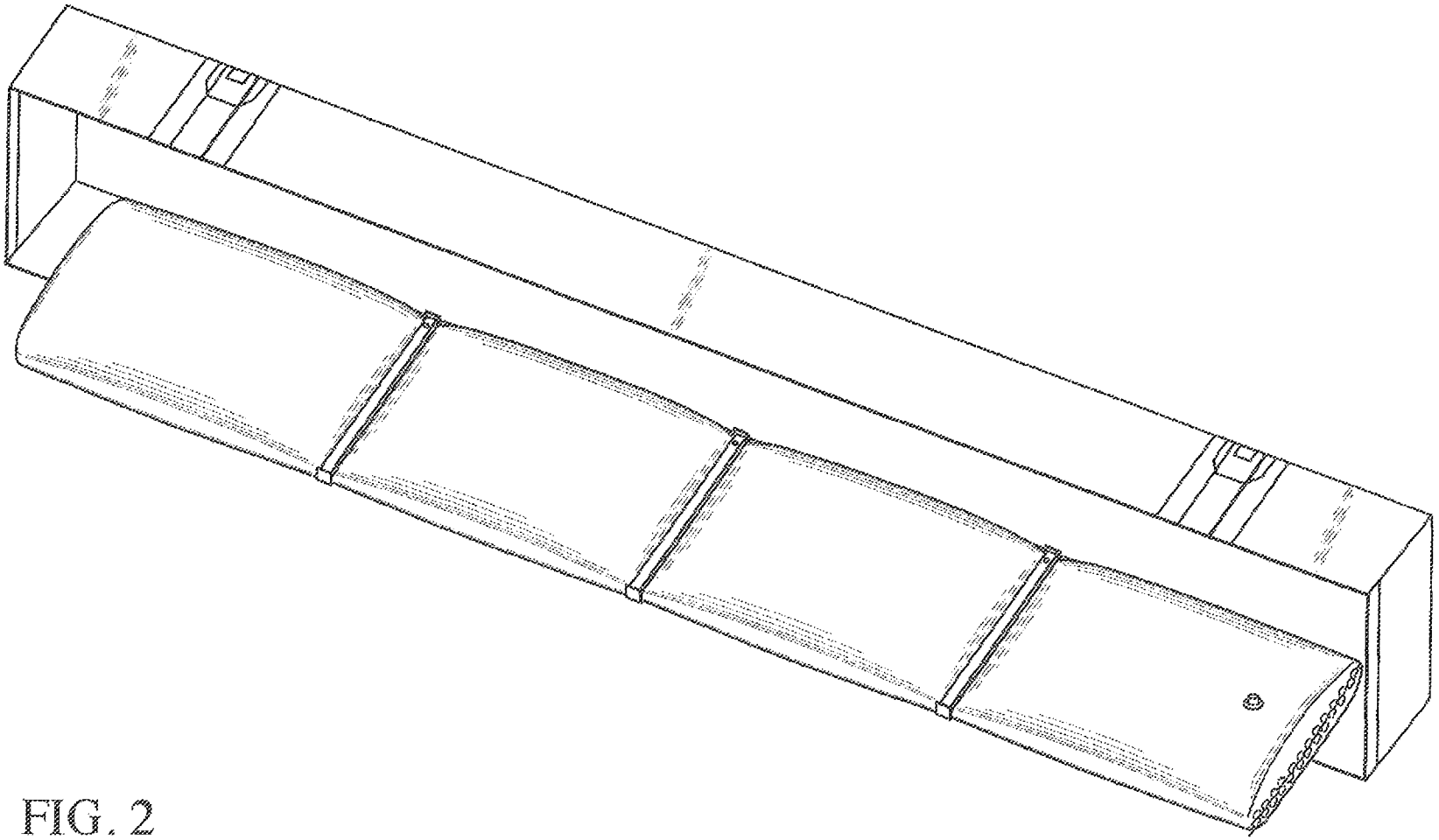

An embodiment of a flexitank is shown in the accompanying figures. FIGS. 1 and 2 show a flexitank resting on the floor of a standard shipping container (horizontal cut away view). The flexitank is shorter than the internal length of the shipping container and its ends fall short of the end walls of the container.

An external cover provides additional strength along the length of the flexitank that will absorb and control the internal liquid dynamics during transport. The external cover for the flexitank is preferably constructed from layers of a 610 gram per square meter vinyl fabric on a base reinforcing scrim of either a 14×14 or 20×20 per centimeter polyester thread. Such a relatively high thread count of the scrim provides added strength for the carriage of liquids with a specific gravity higher than water. The diameter of the covering external layers is dependent on the required capacity of the flexitank.

Figure 3A:
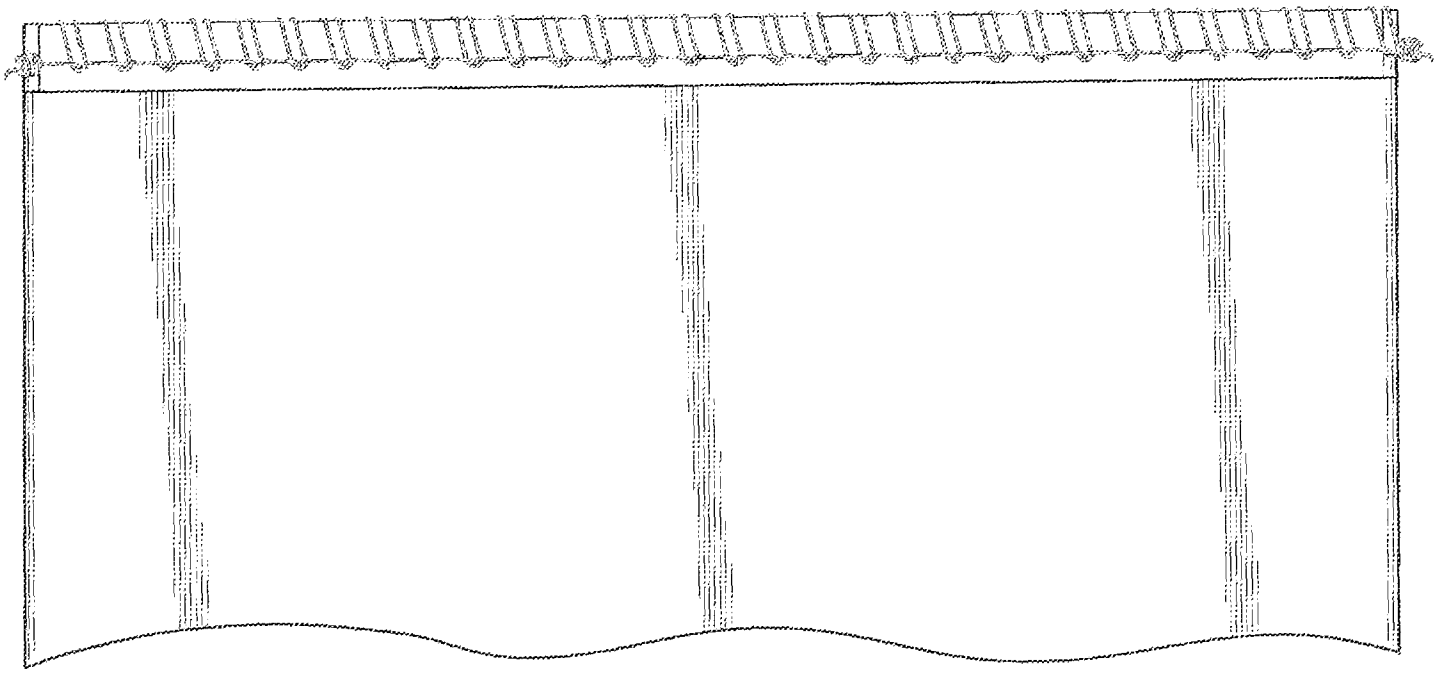
FIG. 3(a) Prior Art
FIGS. 3(*a*), 3(*b*), and 3(*c*) show aspects of a prior art flexible tank.
Figure 3B:
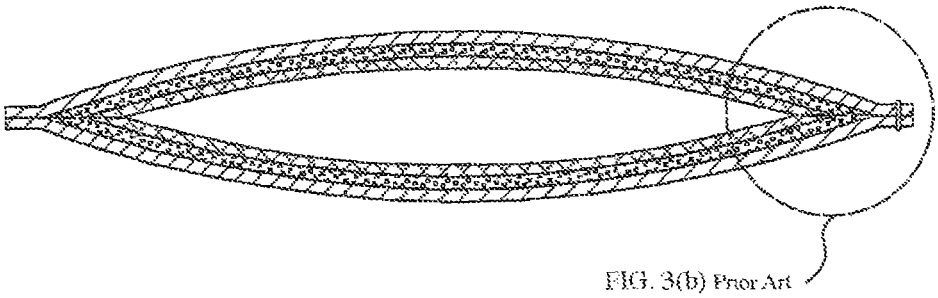
FIG. 3(b) Prior Art
Figure 3C:
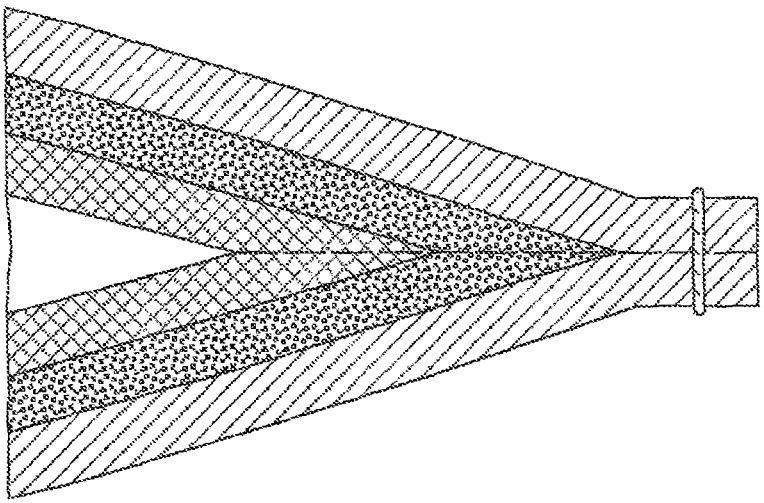
FIG. 3(c) Prior Art
Figure 4:
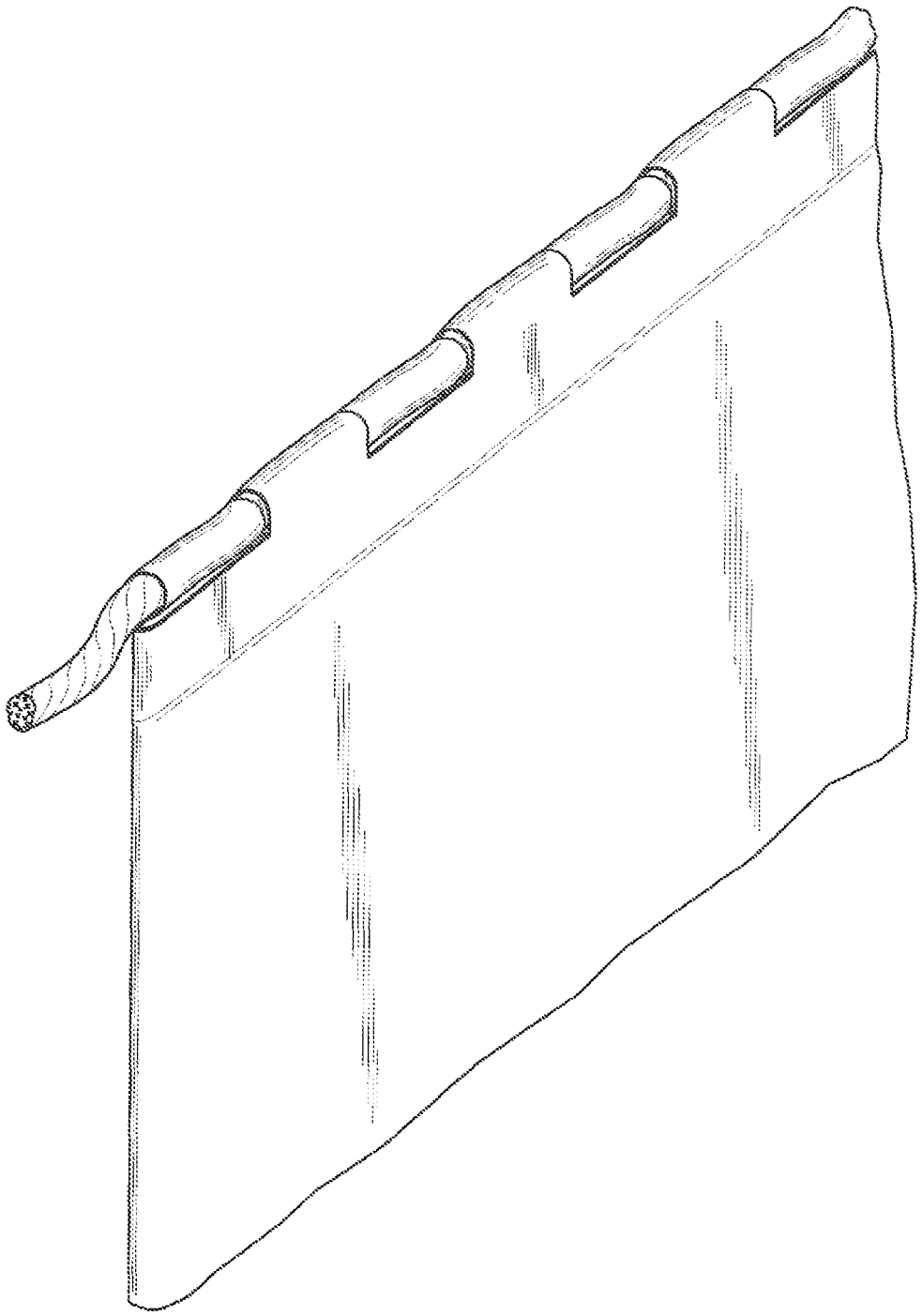
FIG. 4 is a perspective view of part of an end closure for a flexible tank according to one embodiment of the invention.
Figure 5:
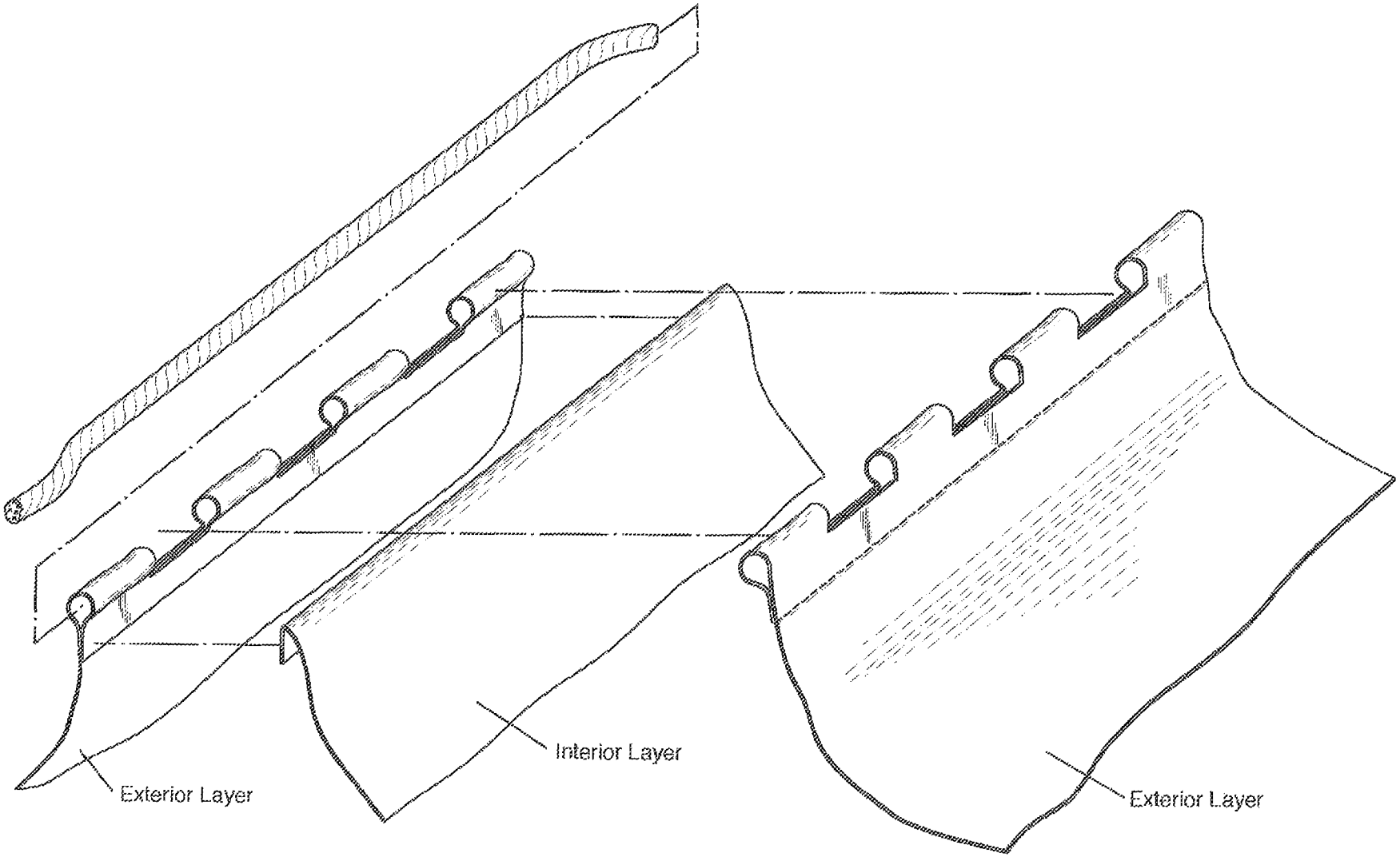
FIG. 5 shows an unassembled view of the components in the end closure of FIG. 4.
Figure 6:
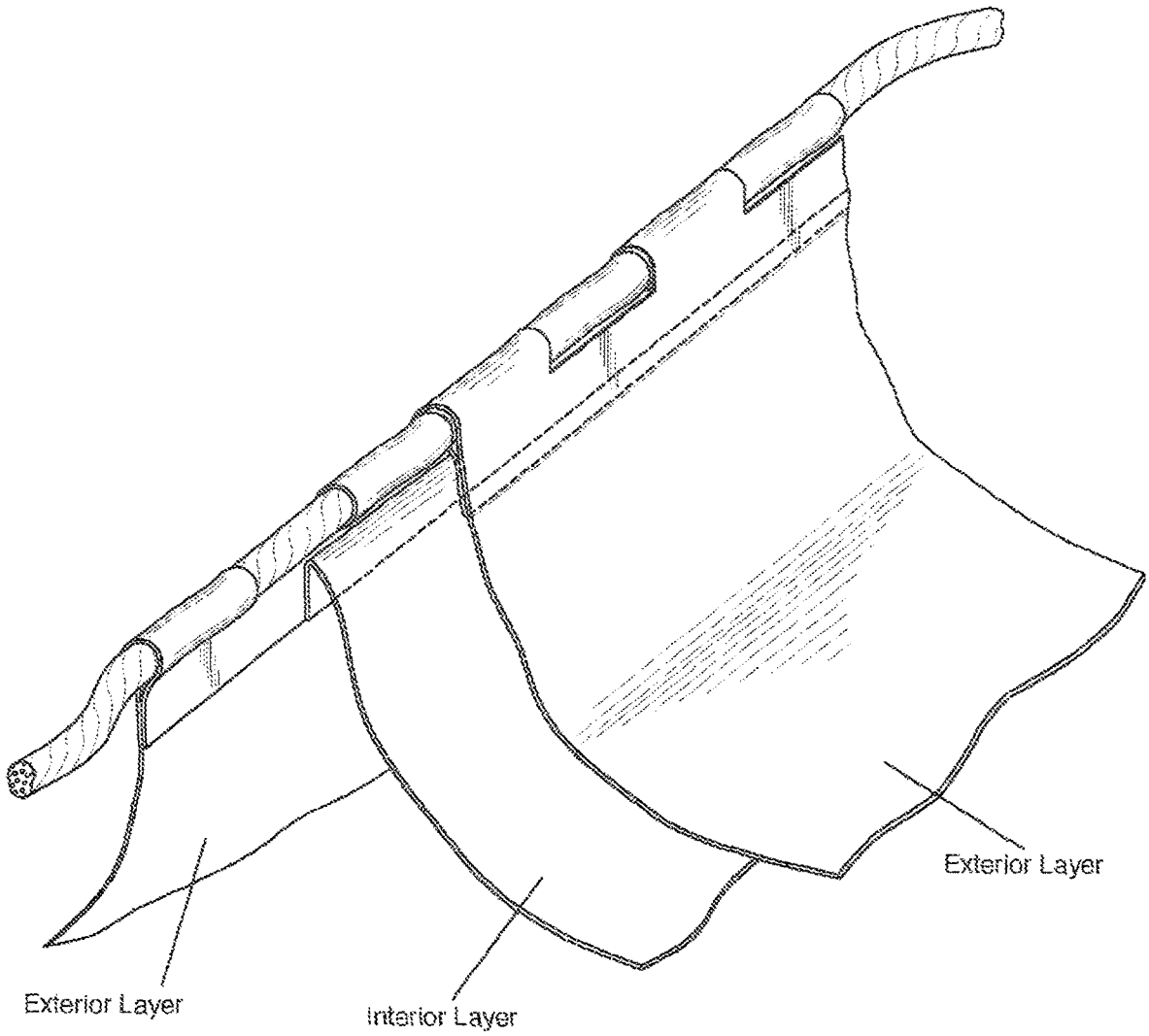
FIG. 6 shows a partially assembled view of the components in the end closure of FIG. 4.
Figure 7A:
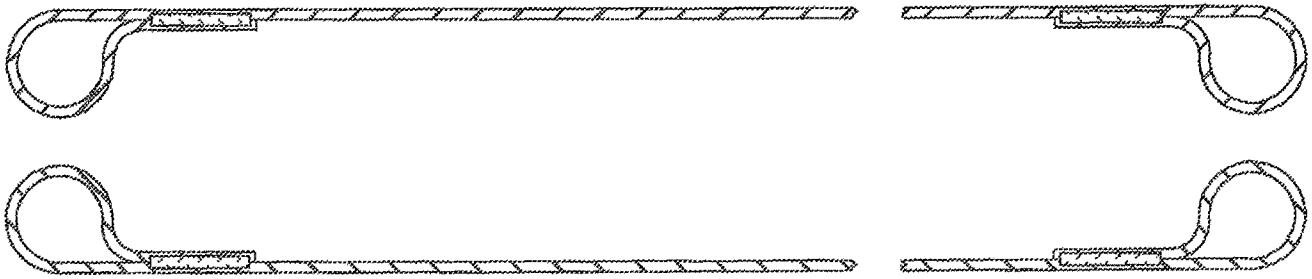
FIGS. 7(*a*) to 7(*e*) show the steps of a preferred method of making a flexible tank.
Figure 7B:
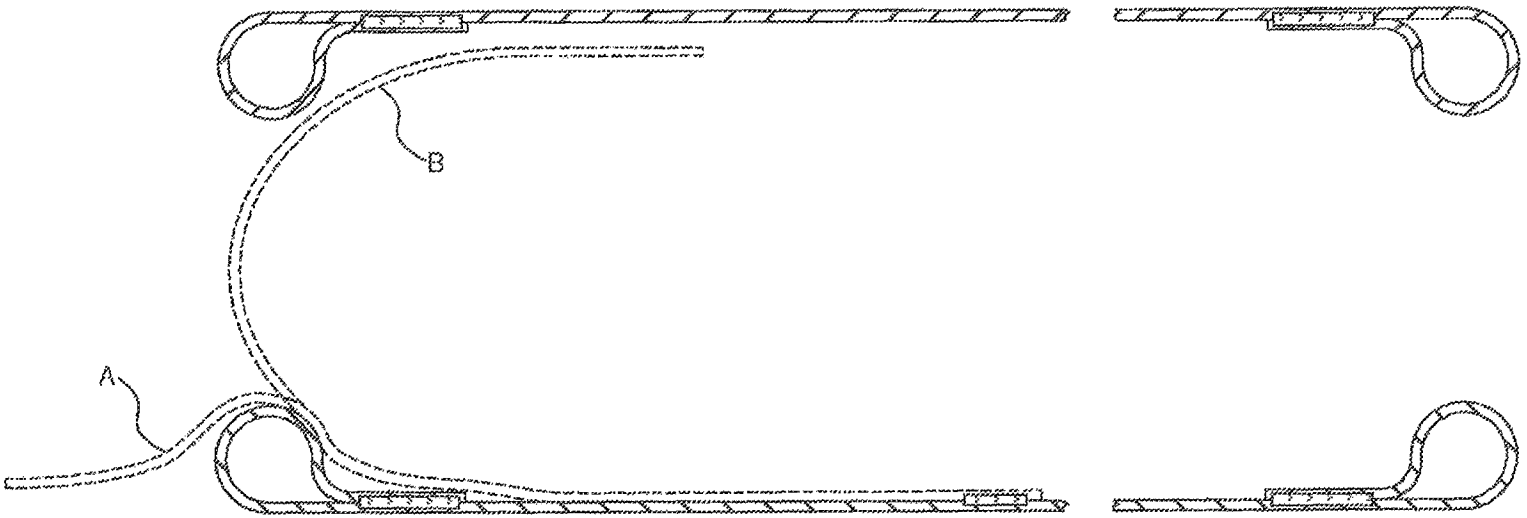
Figure 7C:
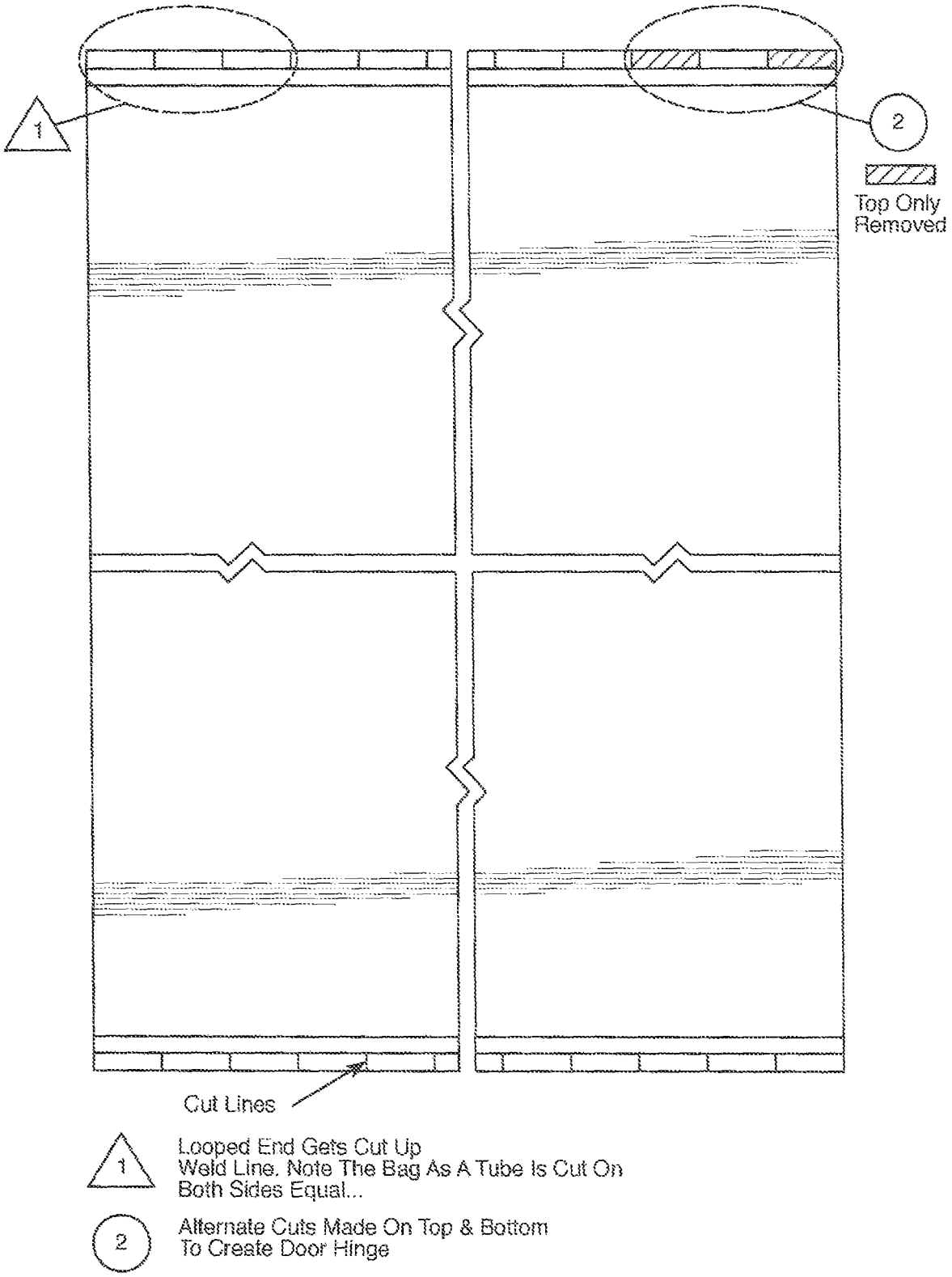
Figure 7D:
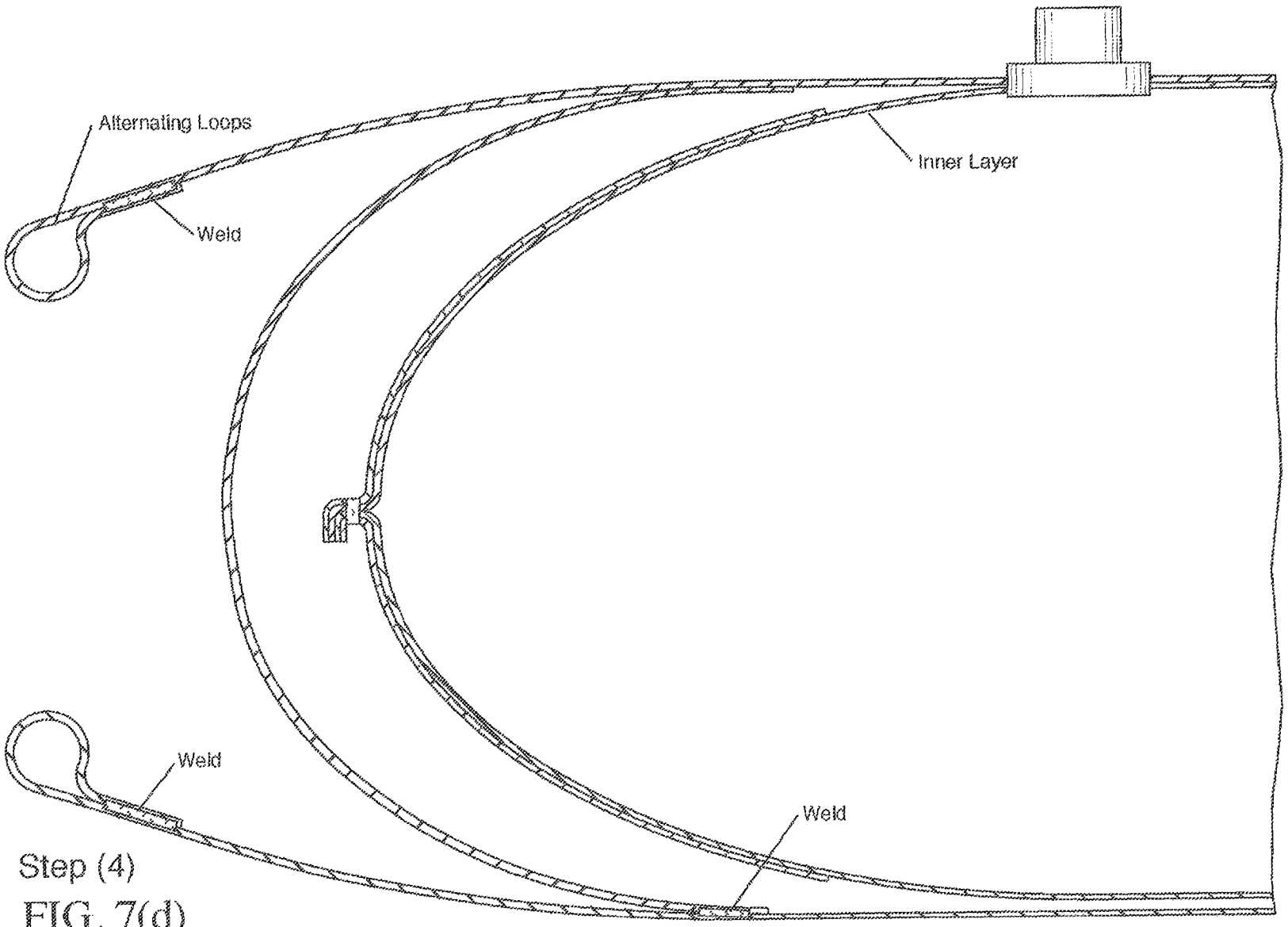
Figure 7E:
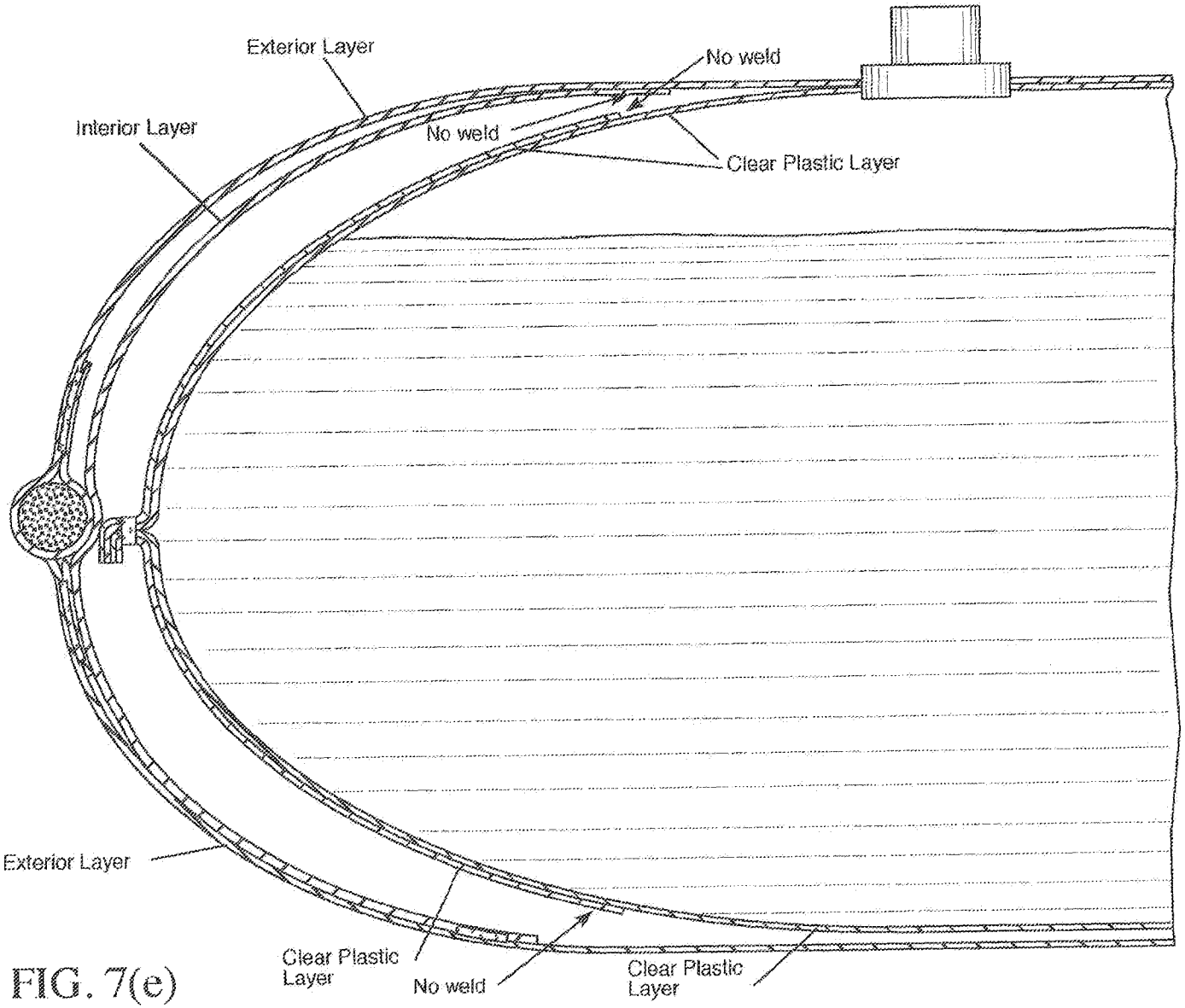

The flexitank external cover may or may not have the end closures shown in FIGS. 4-8, but it does seal both ends of the inner tank and provides additional strength to the heat sealed end seams of the inner tank when compared to the sewn ends shown in FIGS. 3(*a*) to 3(*c*), preventing any bursting of the of the seam when under pressure from the liquid forces placed upon it. The result is a flexitank that is overall much stronger than the conventional flexitank.

A process of forming a flexitank according to one embodiment of the invention is shown in FIGS. 7(*a*)-7(*e*).

In the first step, long and narrow fabric layers are welded together longitudinally, preferably by radio frequency (RF) welding, to form the top and bottom layers of the external cover. The ends of the top and bottom layers are welded back onto itself as shown in FIG. 7(*a*) to form a loop sufficiently large to accept a reinforcement, such as a nylon rope.

In the second step, an end flap is preferably welded to the inside of the bottom layer about 30 to 36 inches from each end of the bottom layer. This end flap may be the same fabric as the top and bottom outer layers. The end flap has the same width as the top and bottom layers and a length of approximately 7 to 8 feet. At this point, the end flap extends past the end of the bottom layer as shown by dashed line A in FIG. 7(*b*). When manufacture of the flexitank is complete, the end flap will be positioned as shown by dashed line B in FIG. 7(*b*). The end flap provides additional reinforcement at the crucial area where the inner tank contacts the ends of the external cover. It is to be understood that, although not shown in the cross-section view, the longitudinal sides of the top and bottom layer of the external cover are welded to each other so as to form an open ended tube.

In the third step, the looped ends of the top and bottom layers of the external cover are cut at the same points to form corresponding equal sized sections of the looped ends as shown in FIG. 7(*c*). Odd loops are removed from one of the layers and even loops are removed from the other layer so that the layers have alternating interlaced loops in the manner of a door hinge. The number of loops is dependent on the width and, preferably, each loop is 6 centimeters long. The loops are positioned in such a way that in a lay-flat position, the loops of the top and bottom external layers will be adjacent to and alternating with each other in an interlaced manner. See FIGS. 4-6.

In the fourth step, a top mounted load/discharge valve is attached to the inner tank through an opening on the top layer of the external cover centrally placed widthwise and near one end seam lengthwise, preferably about 30 to 36 inches from the end. The valve is preferably secured using a clamp. The inner tank, with its 2-4 layers already formed and welded together at the ends, is inserted through the open end of the external cover nearer the valve and positioned between the top and bottom layers. As shown in FIGS. 7(*d*) and 7(*e*), an additional liner having a length substantially the same as the end flap of the external cover is attached to the ends of the inner tank, but not by welding. This additional liner is preferably the same as the layers of the inner tank, especially if the layers of the inner tank are clear plastic layers. Any "coupon" of the inner tank liner at the closed end of the bag is tucked so that it lays flat against the layers of the external cover. Any "coupon" of the inner tank liner at the open end of the bag is tucked and then the end flap of the exterior cover is moved from the position of dashed line A in FIG. 7(*b*), so as to cover the end and the coupon of the inner liner as shown in FIG. 7(*d*) and be positioned over the top of the inner tank liner. Although both are shown in the drawings, another embodiment may have only one or the other of the inner tank liner and the external cover end flap. Also, although illustrated with end closures of loops and rope, the inner tank liner and/or end flap of the external cover may be used with end closures other than those shown in the drawings.

Figure 8:
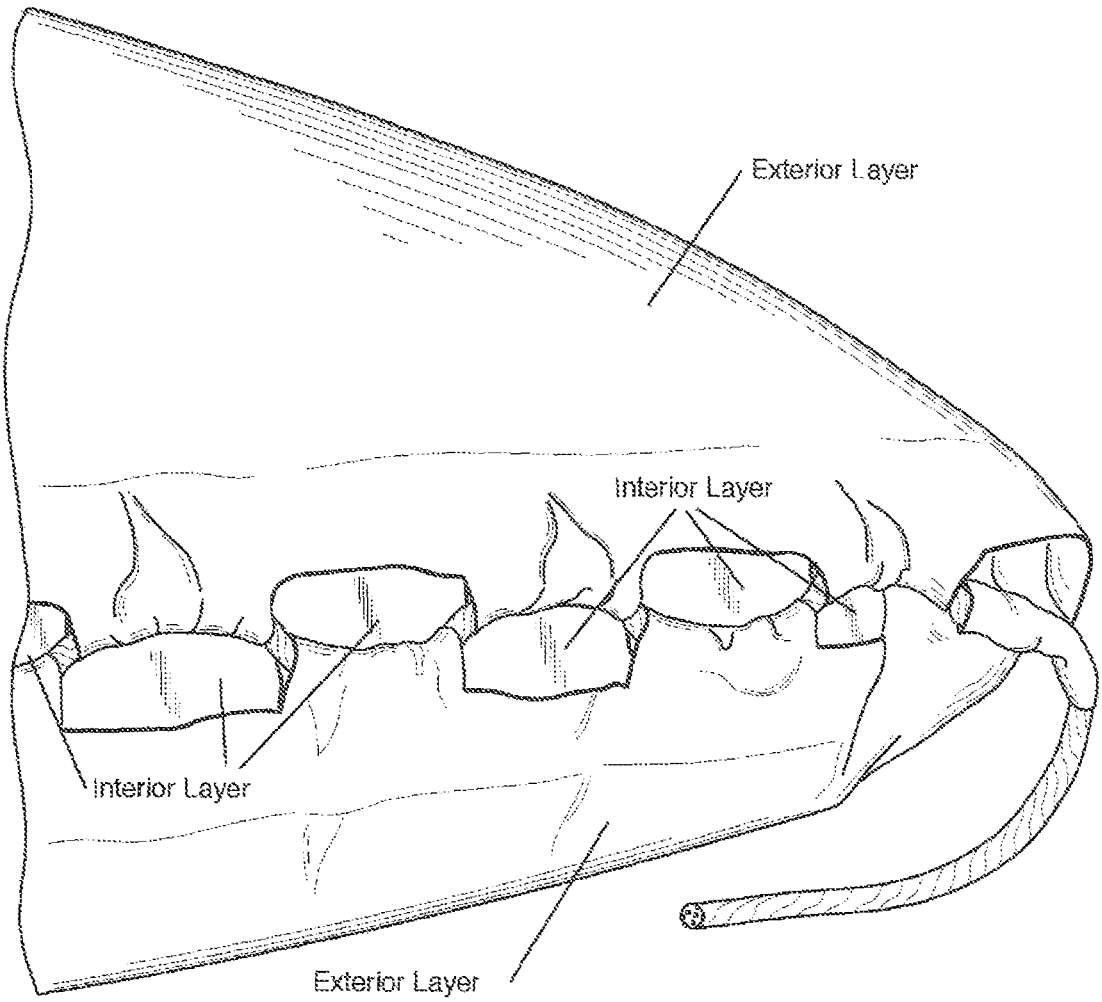
FIG. 8 is a perspective view of part of the end closure of FIG. 4 when the flexible tank is filled with liquid.
Figure 9:
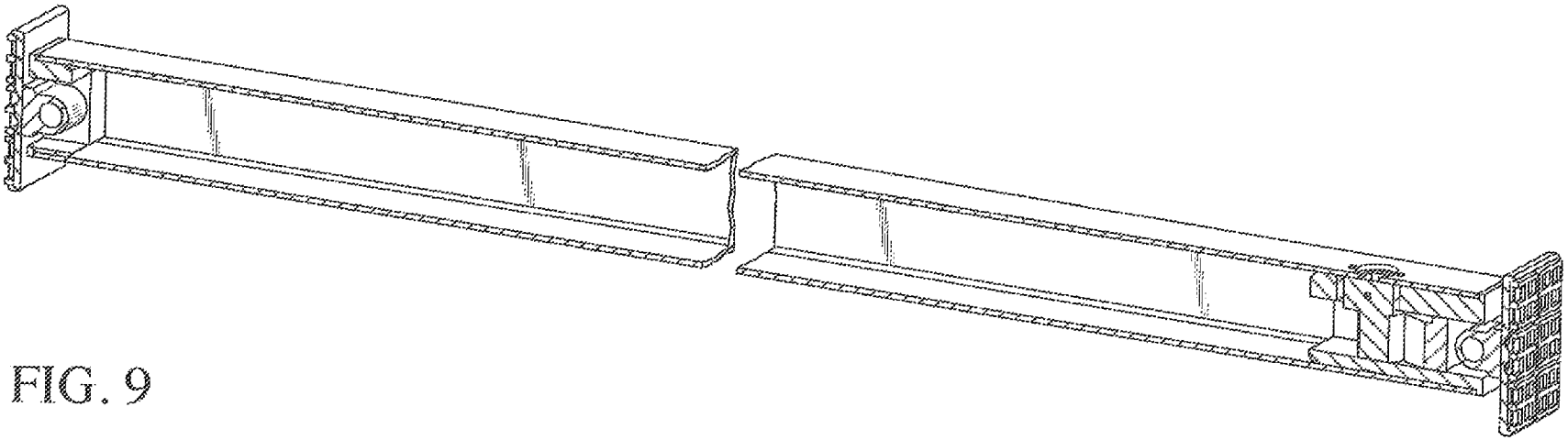
FIG. 9 is a perspective view of an optional baffle that may be used with a flexible tank.
Figure 10:
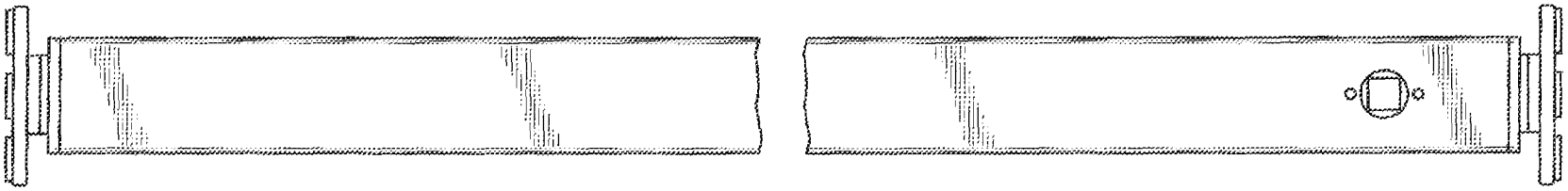
FIG. 10 is a side view of the baffle in FIG. 9.

In the final step, a nylon rope or similar securing element is threaded through the alternating interlaced loops of the open ends of the bag completely across the seams. The rope closes the seams and secures the flexitank into the cover. When the inner tank is filled with liquid as shown in FIG. 7(*e*), the inner tank liner expands pushing against the end flap and against the end closures. It is to be noted that the end closures of the external cover are not watertight and are not intended to be watertight. The end flap provides some protection against leakage but primarily provides additional strength to the end closure. The end flap contains the inner liner inside the external layers of the cover, stopping it from coming into direct contact with the end closure. As shown in FIG. 8, the loops do not remain in alignment and the rope does not remain straight when the flexitank is filled, but they do provide end-closures of significant strength. The rope can be secured in any suitable fashion to keep the end closures closed, and the ends of the rope may be attached, such as to a shipping container, so as to impede movement of the flexible tank, during shipment.

Figure 11:
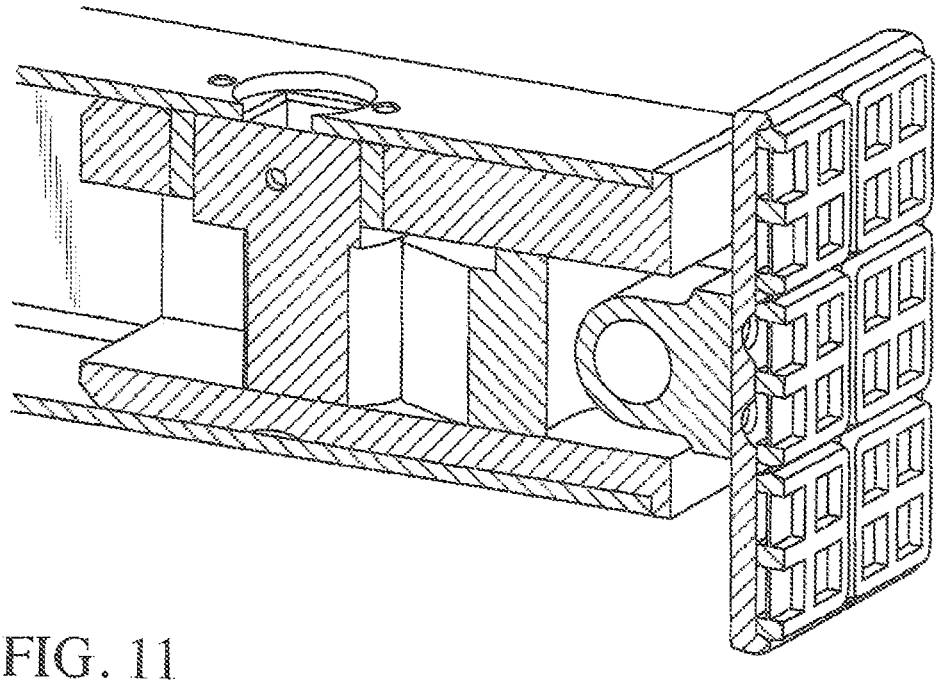
FIGS. 11 and 12 show the ends of the baffle in FIG. 9.
Figure 12:
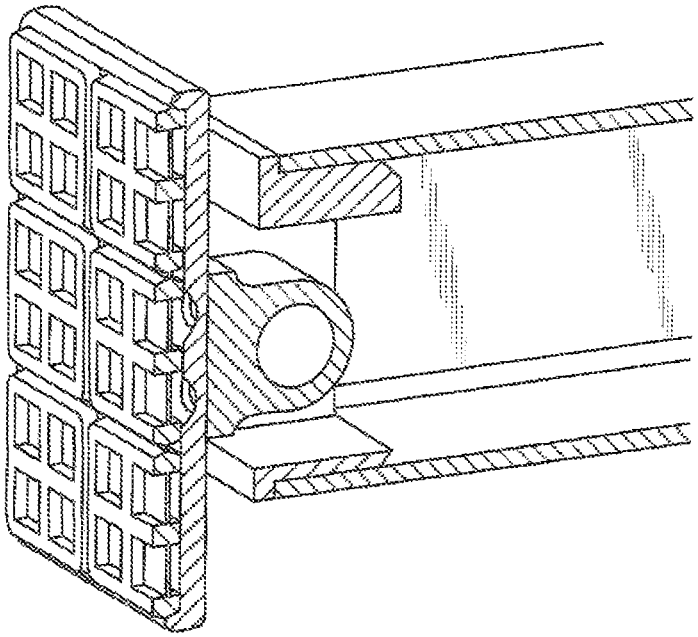

The flexitank is preferably kept relatively low in height. Two or three baffles, external to the flexitank, can optionally be installed in the shipping container to restrict waves during transit. The baffles offer low height channels (for example, from 2-4 inches) for the liquid to flow through and effectively divide a single liner into three or four sections. This controls the liquid dynamics of the liquid and thus reduces dynamic loading on the end-closures of the flexitank. The baffles may be constructed and secured to the container in any suitable manner. Although a shipping container may have the baffles welded or otherwise permanently installed, the presence of the baffles may be a detriment when the container is being used to transport goods without a flexitank. It is preferable that the external baffles may be easily installed in a standard shipping container when a flexitank is used and removed after use. A preferred example of a removable baffle is the compression bar shown in FIGS. 9-12 that locks between the container side walls. One end of the compression bar has the cam system and shoe shown in FIG. 11 and the other end has the shoe shown in FIG. 12. The shoes preferably have metal housings and contact surfaces made of a rubber, and can pivot to accommodate deflection of the container walls under stress. The cam system is accessible by a hole in the top of the compression bar and engaged by a socket drive to move the end of the compression bar in the horizontal direction to lock it into position.

A flexible tank having an end closure according to the invention may vary in multiple ways from the precise description provided herein. In particular, the flexitank with the end closure may be used without the optional baffles and may be used independently of a shipping container. The extra strength provided by the end closure may permit a flexible tank to be used in a variety of industries, purposes, circumstances, and environments not specifically identified herein.

The invention claimed is:

1. A flexible tank for transporting bulk liquids or semi-liquid materials, comprising:

an interior tank made of a flexible water-proof polymeric material, said interior tank being generally rectangular in shape with a width of at least one end of the interior tank being less than the length of the interior tank, the interior tank enclosing within it the bulk liquid or semi-liquid materials being transported;

a first exterior layer made of a flexible polymeric material in a generally rectangular shape, the first exterior layer having longitudinal sides and a first end in a widthwise direction;

a second exterior layer made of a flexible polymeric material in a shape and size substantially similar to the first exterior layer, the second exterior layer having longitudinal sides and a first end in the widthwise direction of the second exterior layer, the longitudinal sides of the first and second exterior layers being connected to form an open ended tube, the first end of the second exterior layer being matched up with the first end of the first exterior layer;

an end closure connecting the first ends of the first and second exterior layers to each other, the end closure not being watertight; and an end flap, a first end of the end flap is attached to the inside of one of the first and second exterior layers, the length of the end flap being greater than the distance from its point of attachment to the first end of the open ended tube, the interior tank being constrained within the first and second exterior layers by the end flap such that, when the inner tank is filled, the inner tank expands pushing against the end flap and against the end closure connecting the first and second exterior layers to each other, and the end flap provides protection against leakage with additional strength provided by the end closure connecting the first ends of the first and second exterior layers.

2. The flexible tank of claim 1, wherein said interior tank has multiple layers, at least one of said multiple layers of said interior tank being attached to said first exterior layer or said second exterior layer.

3. The flexible tank of claim 2, wherein said at least one of said multiple layers of said interior tank is attached to said first exterior layer or said second exterior layer by a weld.

4. The flexible tank of claim 3, wherein at least one of said multiple layers of said interior tank has a coupon or seam and said coupon or seam is folded inside of said first and second exterior layers.

5. The flexible tank of claim 1, where the hollow loops comprise folded over portions of the first and second exterior layers.

6. The flexible tank of claim 1, wherein the spaces comprise cut-outs from the flexible polymeric material.

7. The flexible tank of claim 1, wherein the flexible tank is at least 20 feet in length.

8. The flexible tank of claim 1, wherein the flexible tank has a capacity of more than 8,000 liters.

9. A method of manufacturing a flexible tank for the transport of bulk liquids or semi-liquid materials, comprising:

folding over the ends of rectangular shaped first and second layers of flexible polymeric material to form a continuous loop over the entirety of the width of said ends of said first and second layers;

connecting the longitudinal sides of the first and second layers to form an open ended tube;

attaching a first end of a first end flap to the inside of one of the first and second layers near a first end of the open ended tube and a first end of a second end flap to the inside of one of the first and second layers near a second end of the open ended tube, the length of the first end flap being greater than the distance from its point of attachment to the first end of the open ended tube and the length of the second end flap being greater than the distance from its point of attachment to the second end of the open ended tube;

cutting portions from each one of the continuous loops of said ends of said first and second layers so as to become a sequence of alternating hollow loops and spaces, the hollow loops and spaces of the first layer interlacing with the hollow loops and spaces of the second layer;

inserting an inner liner into the interior space of the open ended tube formed by connecting the longitudinal sides of the first and second layers, the inner liner made of a flexible water-proof polymeric material so as to enclose within it the bulk liquid or semi-liquid materials being transported;

moving the respective second ends of the first and second end flaps to cover the ends of the inner liner; and closing the first and second ends of the flexible tank with the inner liner and end flaps constrained therein by threading a rope between the interlaced hollow loops of the first and second layers.

10. A method of manufacturing a flexible tank as set forth in claim 9, further comprising the first and second end flaps being attached by a weld to one of the first and second layers.

11. A method of manufacturing a flexible tank as set forth in claim 10, further comprising the first and second end flaps being attached about 30 to 36 inches from the ends of the open ended tube.

12. A method of manufacturing a flexible tank for the transport of bulk liquids or semi-liquid materials, comprising:

folding over the ends of rectangular shaped first and second exterior layers of flexible polymeric material to form a continuous loop over the entirety of the width of said ends of said first and second exterior layers;

connecting the longitudinal sides of the first and second exterior layers to form an open ended tube;

attaching a first end of a first end flap to the inside of one of the first and second exterior layers near a first end of the open ended tube and a first end of a second end flap to the inside of one of the first and second exterior layers near a second end of the open ended tube, the length of the first end flap being greater than the distance from its point of attachment to the first end of the open ended tube and the length of the second end flap being greater than the distance from its point of attachment to the second end of the open ended tube;

inserting an inner liner into the interior space of the open ended tube formed by connecting the longitudinal sides of the first and second exterior layers, enabling the inner liner to enclose within it the bulk liquid or semi-liquid materials being transported;

moving the respective second ends of the first and second end flaps to cover the ends of the inner liner; and closing the first and second ends of the flexible tank with the inner liner and end flaps by an end closure that is not watertight, the end flaps being constrained therein by the end closures.

13. A method of manufacturing a flexible tank as set forth in claim 12, further comprising the first and second end flaps being attached by a weld to one of the first and second exterior layers.

14. A method of manufacturing a flexible tank as set forth in claim 13, further comprising the first and second end flaps being attached about 30 to 36 inches from the ends of the open ended tube.

15. The flexible tank of claim 4, wherein the coupon or seam is folded inside of the end flap.

16. The flexible tank of claim 1, wherein the flexible tank further comprises a single valve through which the bulk liquid or semi-liquid materials are transferred into and out of the flexible tank.

17. The flexible tank of claim 16, further comprising a plurality of baffles across the width of the flexible tank restricting surges of the bulk liquid or semi-liquid materials within the flexible tank, said plurality of baffles forming at least three sections and controlling the liquid dynamics in the flexible tank, during transit.

18. The flexible tank of claim 17, wherein the baffles are baffles located external to the flexible tank.

19. The flexible tank of claim 17, wherein said at least three sections are interconnected and can each be loaded and unloaded with the bulk liquid or semi-liquid materials through said single valve.

* * * * *